US007246493B2

(12) United States Patent
Flohr et al.

(10) Patent No.: US 7,246,493 B2
(45) Date of Patent: Jul. 24, 2007

(54) GAS TURBINE

(75) Inventors: Patrick Flohr, Winter Springs, FL (US); Werner Krebs, Mülheim (DE); Bernd Prade, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 301 days.

(21) Appl. No.: 10/506,121

(22) PCT Filed: Feb. 24, 2003

(86) PCT No.: PCT/EP03/01862

§ 371 (c)(1),
(2), (4) Date: Aug. 31, 2004

(87) PCT Pub. No.: WO03/074936

PCT Pub. Date: Sep. 12, 2003

(65) Prior Publication Data

US 2005/0144950 A1 Jul. 7, 2005

(30) Foreign Application Priority Data

Mar. 7, 2002 (EP) ..... 02005137

(51) Int. Cl.
*F02C 7/045* (2006.01)
*F02K 3/14* (2006.01)

(52) U.S. Cl. ..... 60/725

(58) Field of Classification Search ..... 60/725, 60/737, 748; 431/114, 183
See application file for complete search history.

(56) References Cited

U.S. PATENT DOCUMENTS

| | | | | |
|---|---|---|---|---|
| 3,819,009 | A * | 6/1974 | Motsinger | 181/292 |
| 4,122,674 | A | 10/1978 | Andersson et al. | |
| 4,231,447 | A * | 11/1980 | Chapman | 181/213 |
| 4,589,260 | A * | 5/1986 | Krockow | 60/737 |
| 5,644,918 | A | 7/1997 | Gulati et al. | |
| 5,660,045 | A * | 8/1997 | Ito et al. | 60/737 |
| 6,019,596 | A * | 2/2000 | Knopfel et al. | 60/737 |
| 6,058,709 | A | 5/2000 | Richards et al. | |
| 6,305,927 | B1 * | 10/2001 | Keller | 431/114 |
| 6,351,947 | B1 * | 3/2002 | Keller et al. | 60/725 |
| 6,370,879 | B1 * | 4/2002 | Stalder et al. | 60/725 |
| 6,374,593 | B1 * | 4/2002 | Ziegner | 60/737 |
| 6,632,084 | B2 * | 10/2003 | Berenbrink | 431/284 |
| 6,981,358 | B2 * | 1/2006 | Bellucci et al. | 60/725 |

FOREIGN PATENT DOCUMENTS

| | | |
|---|---|---|
| EP | 0 577 862 A1 | 1/1994 |
| EP | 0 597 138 A1 | 5/1994 |
| EP | 0 971 172 A1 | 1/2000 |
| EP | 1 004 823 A2 | 5/2000 |
| EP | 1 158 247 A2 | 11/2001 |
| WO | WO 93/10401 | 5/1993 |

* cited by examiner

*Primary Examiner*—Ted Kim

(57) ABSTRACT

The invention relates to a gas turbine comprising a combustor that extends into a combustion chamber. The port of the combustor is surrounded in a ring-shaped manner by a Helmholtz resonator, whereby combustion oscillations are effectively suppressed due to close contact with the flame while irregularities in temperature are prevented.

9 Claims, 2 Drawing Sheets

GAS TURBINE

CROSS REFERENCE TO RELATED APPLICATION

This application is the US National Stage of International Application No. PCT/EP03/01862, filed Feb. 24, 2003 and claims the benefit thereof. The International Application claims the benefits of European Patent application No. 02005137.1 EP filed Mar. 7, 2002, both of the applications are incorporated by reference herein in their entirety.

FIELD OF THE INVENTION

The invention relates to a gas turbine having a combustor which leads into a combustion chamber. In particular, the combustion chamber is designed as an annular combustion chamber.

BACKGROUND OF THE INVENTION

In combustion systems such as gas turbines, aircraft engines, rocket motors and heating systems, thermoacoustically induced combustion oscillations can occur. These are caused by an interaction of the combustion flame and the associated heat release with acoustic pressure fluctuations. As a result of an acoustic stimulation, the location of the flame, the flame front surface or the mixture composition can fluctuate, thereby causing fluctuations in the heat release. In the case of constructive phase positions, positive feedback and amplification can occur. Such an amplified combustion oscillation can result in significant noise exposure and damage due to vibrations.

These thermoacoustically induced instabilities are greatly influenced by the acoustic properties of the combustion chamber and the marginal conditions which are present at the combustion chamber entrance and combustion chamber exit and at the combustion chamber walls. The acoustic properties can be changed by installing Helmholtz resonators.

WO 93/10401 A1 shows a device for suppressing combustion oscillations in a combustion chamber of a gas turbine installation. A Helmholtz resonator is connected to the flow of a fuel feed line. The acoustic properties of the feed line or of the acoustic overall system are thereby changed in such a way that combustion oscillations are suppressed. However, it is also apparent that this measure is not sufficient in all operating states, since combustion oscillations can still occur when oscillations in the fuel line are suppressed.

U.S. Pat. No. 6,058,709 proposes the introduction of fuel at axially differing positions in the combustion channel of a combustor, in order to avoid combustion oscillations. Consequently, with regard to the development of combustion oscillations, constructive phase positions in the mixture composition are superimposed by destructive phase positions, thereby achieving lower fluctuations overall and therefore a decreased tendency to develop combustion oscillations. In terms of equipment, however, this measure is relatively expensive in comparison with the purely passive measure of using Helmholtz resonators.

EP 0 597 138 A1 describes a gas turbine combustion chamber which features air-flushed Helmholtz resonators in the vicinity of the combustors. The resonators are arranged alternately at the front of the combustion chamber between the combustors. Vibrational energy from combustion oscillations which occur in the combustion chamber is absorbed by these resonators, and the combustion oscillations are consequently attenuated.

A further measure for attenuating combustion oscillations is shown in EP 1 004 823 A2. In this case, a Helmholtz resonator is connected directly to the mixing area of the combustor. The resonator is attached upstream of the fuel feed, since combustion oscillations deriving from the resonator in the combustor and also combustion oscillations which are caused by the feed lines are to be absorbed.

U.S. Pat. No. 5,644,918 discloses a combustion chamber having a resonator which is designed in the form of a cylindrical double sleeve, said resonator being arranged concentrically between a combustion chamber casing and a combustion chamber liner. The double sleeve is formed inter alia by an annular flange and the inner surface of the combustion chamber casing.

The invention addresses the problem of specifying a gas turbine which has a particularly low tendency to develop combustion oscillations, wherein structural measures at a combustion chamber wall are to be avoided.

SUMMARY OF THE INVENTION

This problem is solved by specifying a gas turbine including a combustion chamber and a combustor which leads into the combustion chamber at a combustor port, wherein the combustor port is surrounded annularly by a Helmholtz resonator and wherein provision is made for the characterizing features in Claim 1 in accordance with the invention.

It is therefore proposed for the first time to arrange a Helmholtz resonator around the port of a combustor. In accordance with the findings of the invention, the attenuation of combustion oscillations by a resonator can result in local temperature differences if the resonator acts unevenly on the combustion area. This is avoided by the symmetrical annular arrangement around the combustor flame. The resulting temperature homogenizing increases the attenuating effect and at the same time results in a decrease in the formation of nitrogen oxide. Additionally, by arranging the resonator directly around the flame, it is possible intensively to act directly on the location of the greatest heat release. This improved contact with the main source of combustion oscillations also increases the effect of the resonator.

The Helmholtz resonator preferably has a resonator volume and leads into the combustion chamber at a resonator port, wherein the resonator port extends into the resonator volume by means of a small tube. Furthermore, the resonator port is preferably formed by a plurality of openings, each of which extends into the resonator volume by means of a small tube. The small tubes therefore project into the resonator volume. As a result of this design, it is possible to keep the size of the resonator small. A resonator usually consists of a volume V and holes of a specific length I and cross section A. In conjunction with the sound velocity c, this geometry determines the resonance frequency in accordance with the simplified formula $f_{res}=c/(2\pi)\sqrt{[A/(V\cdot l)]}$. In order to combat low frequencies, therefore, a very large volume is required. However, this presents considerable difficulties in practice due to the small amount of available space. In the apparatus described here, the length of the holes is increased significantly. This is achieved by designing the holes as small tubes which project into the volume. The internal volume of the resonator is hardly changed in this way. The external dimensions of the resonator can therefore be kept small. The small tubes can also be designed such that they are twisted, thus ensuring adequate distance relative to the walls. By changing the length of the small tubes, the attenuation apparatus can be adjusted to any desired frequency which occurs in the combustion system. In this case, it is not necessary to change the external dimensions of the resonator, and hence of the combustor insert, or the open overall cross-sectional area. The main advantage: in order to attenuate low frequencies, it is possible to forgo an increase in the volume of the resonator by virtue of the inwardly projecting small tubes.

The small tube or the small tubes are preferably twisted or curved in form, such that the length of the small tube is increased while nonetheless respecting the minimum distance to the resonator wall.

The resonator volume is preferably adjustable, e.g. by moving a resonator wall in the manner of a piston. The acoustic properties, particularly the impedance, can be adapted and adjusted in this way.

In a preferred configuration, the combustion chamber is designed as an annular combustion chamber. Precisely in the case of annular combustion chambers, combustion oscillations can result in highly interfering and damaging combustion oscillations due to a comparatively large combustion chamber volume and intercoupled combustors therein. In addition, the acoustic properties of such a combustion chamber are barely calculable.

According to the invention, the Helmholtz resonator is integrated in a combustor insert, wherein the combustor is connected to the combustion chamber via the combustor insert. The combustor insert can be a separate component which is screwed onto the combustion chamber wall, for example, the actual combustor then being installed in said insert. However, it can also be connected to the combustor in such a way that, for example, the combustor insert forms a flange at the combustor, with which the combustor is connected to the combustion chamber wall. By integrating the resonator in the combustor insert, no structural measures are required at the combustion chamber wall and the resonator can be removed easily if required.

The Helmholtz resonator is preferably designed to allow direct airflow. The impedance of the resonator can be modified and adapted easily as a result of this. Furthermore, a cooling of the resonator and, if the resonator is integrated in the combustor insert, a cooling of the complete combustor insert is achieved.

BRIEF DESCRIPTION OF THE DRAWINGS

By way of example, and to some extent schematically, the invention is explained with reference to the drawing in which.

DETAILED DESCRIPTION OF THE INVENTION

Identical reference signs have the same meaning in the different figures.

Figure 1:
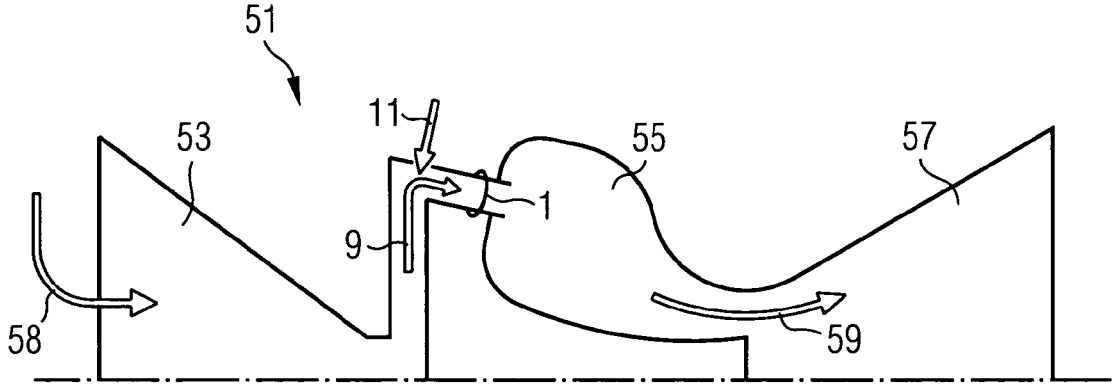
FIG. 1 shows a gas turbine.

A gas turbine 51 is depicted in FIG. 1. The gas turbine 51 has a compressor 53, an annular combustion chamber 55 and a turbine part 57. Air 58 from the environment is supplied to the compressor 53 and is greatly compressed there to form combustion air 9. The combustion air 9 is then supplied to the annular combustion chamber 55. There it is combusted with fuel 11 to form a hot gas 59. The hot gas 59 drives the turbine part 57.

Figure 2:
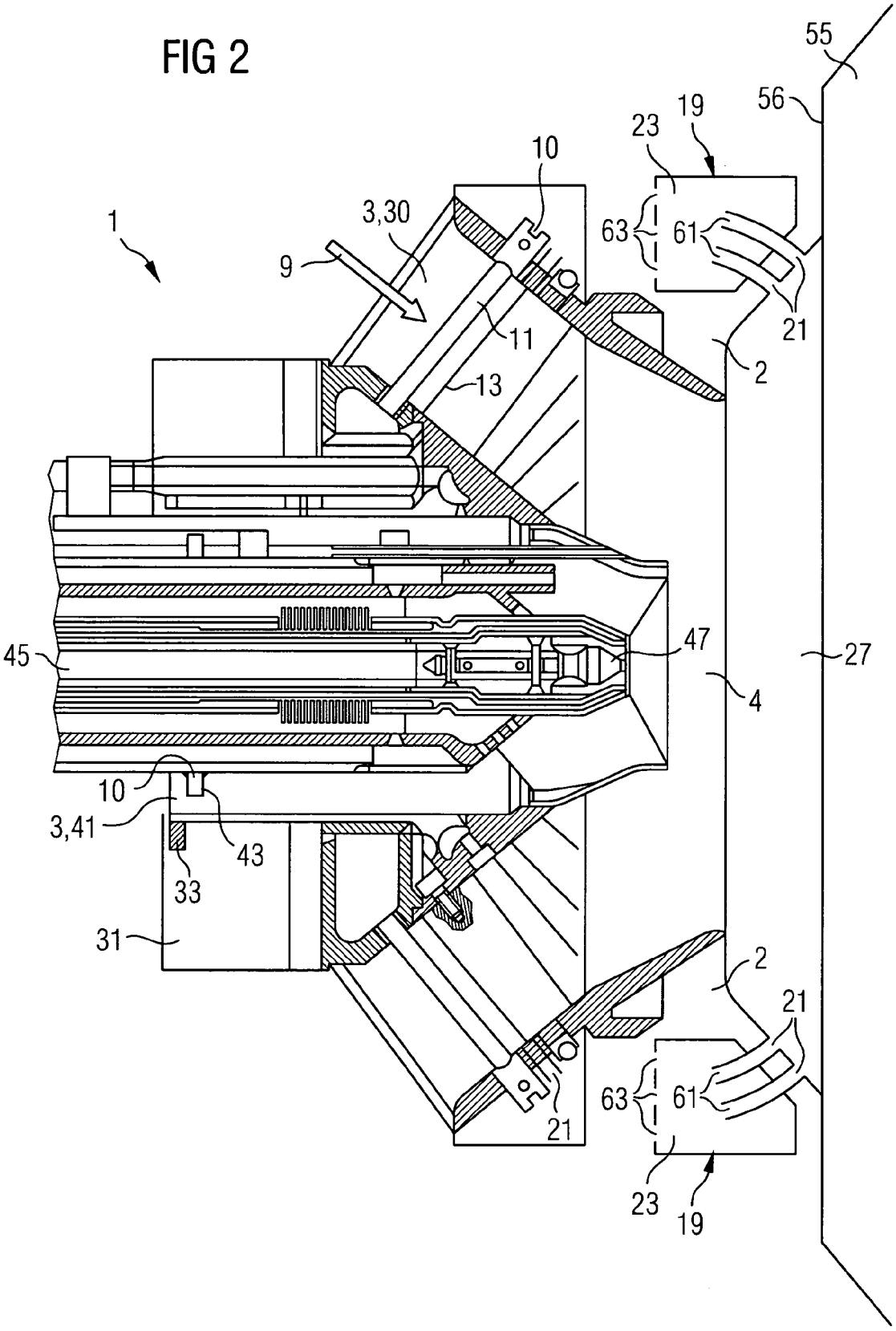
FIG. 2 shows a combustor with is arranged at a combustion chamber wall.

Combustion oscillations can develop in the annular combustion chamber 55 for the reasons described above, and said combustion oscillations can have a significant adverse effect on the operation of the gas turbine 51. Helmholtz resonators can be used for attenuating such combustion oscillations, wherein a particularly effective design is described below:

FIG. 2 illustrates a gas turbine combustor 1 which is connected to a combustion chamber wall 56 of a combustion chamber 55 via a combustor insert 2 and leads into a combustor port 4 in the combustion chamber 55. A combustor channel 3 of the gas turbine combustor 1 surrounds a central channel 41 as an annular channel 30. The annular channel 30 is designed as a premixing channel, in which fuel 11 and combustion air 9 are intensively mixed prior to the combustion. This is called premix combustion. The fuel 11 is fed into the annular channel 30 via hollow twisted blades 13. The central channel 41 leads into the combustion zone 27, together with a central fuel lance 45 which supplies fuel 47, in particular oil, via a swirl nozzle 47. In this case, fuel 11 and combustion air 9 are mixed for the first time in the combustion zone 27, and this is known as diffusion burning. However, it is also possible to add fuel 11, in particular natural gas, into the central channel 41 upstream of the combustion zone 27 via a fuel inlet 43.

A Helmholtz resonator 19 is integrated in the combustor insert 2, said Helmholtz resonator having a resonator volume 23 and leading into the combustion chamber 55 via a resonator port 21 which consists of holes. A small tube 61 which is twisted in shape connects into the resonator volume 23 at each of the holes. The Helmholtz resonator 19 surrounds the combustor port 4 annularly.

The annular enclosure of the combustor port 4 by the resonator 19 results in a uniform action on the combustion zone 27. Consequently the resonator 19 does not cause temperature irregularities. Moreover, the resonator 19 acts very effectively directly on the zone of greatest heat release.

The small tubes 61 allow a comparatively small size for the resonator 19, such that said resonator can be integrated in the combustor insert 2. Air is introduced into the resonator 19 via air inlets 63, thereby allowing said resonator to be adapted in respect of its impedance and also allowing said resonator to be cooled.

The invention claimed is:

1. A gas turbine, comprising: a combustion chamber; a combustor that leads into the combustion chamber at a combustor port and is connected to the combustion chamber via a combustor insert distinct from both the combustor port and the combustor; and a Helmholtz resonator surrounding the combustor port, wherein, the Helmholtz resonator is integrated in the combustor insert, having a resonator volume connected to the combustion chamber by a resonator port, and including a small tube extending from the port into the resonator volume.

2. The gas turbine as claimed in claim 1, wherein the small tube is curved or twisted in form.

3. The gas turbine as claimed in claim 1, wherein the small tube is curved and twisted in form.

4. The gas turbine as claimed in claim 1, wherein the resonator volume is adjustable.

5. The gas turbine as claimed claim 1, wherein the combustion chamber is designed as an annular combustion chamber.

6. The gas turbine as claimed in claim 1, wherein the resonator surrounds the combustor port annularly.

7. The gas turbine as claimed in claim 6, wherein the resonator port includes multiple holes with a tube extending from each hole into the resonator volume.

8. The gas turbine as claimed in claim 1, wherein the resonator includes a plurality of air inlets allowing the resonator impedance to be adapted.

9. The gas turbine as claimed in claim 1, wherein combustor airflow is directed through the Helmholtz resonator.

* * * * *